US006123558A

United States Patent [19]

Shibata

[11] Patent Number: 6,123,558

[45] Date of Patent: Sep. 26, 2000

[54] CARD EDGE CONNECTOR WITH INSERTION DIRECTION INDICATORS

[75] Inventor: Junichiro Shibata, Tokyo, Japan

[73] Assignee: NEC Corporation, Tokyo, Japan

[21] Appl. No.: 09/190,816

[22] Filed: Nov. 12, 1998

[30] Foreign Application Priority Data

Nov. 12, 1997 [JP] Japan ..... 9-310602

[51] Int. Cl.[7] ..... H01R 13/62

[52] U.S. Cl. ..... 439/157; 439/488; 439/491; 439/160

[58] Field of Search ..... 439/157, 160, 439/152, 155, 488, 633, 677, 153, 491

[56] References Cited

U.S. PATENT DOCUMENTS

| | | | |
|---|---|---|---|
| 2,892,175 | 6/1959 | Frey | 439/488 |
| 4,202,351 | 5/1980 | Biche | 439/491 |
| 4,227,762 | 10/1980 | Scheiner | 439/488 |
| 4,784,614 | 11/1988 | Sadigh-Behzadi | 439/488 |
| 4,820,193 | 4/1989 | Noorily | 439/488 |
| 4,913,981 | 4/1990 | Hynes et al. | 439/491 |
| 5,470,240 | 11/1995 | Suzuki | 439/157 |
| 5,775,935 | 7/1998 | Barna | 439/488 |

FOREIGN PATENT DOCUMENTS 8-148222 6/1996 Japan .

*Primary Examiner*—Gary F. Paumen
*Assistant Examiner*—Tho D. Ta
*Attorney, Agent, or Firm*—Young & Thompson

[57] ABSTRACT

A card edge connector includes a slot for receipt of a circuit board or a circuit card, a first eject lever in a first side of said slot, and a second eject lever in a second side of said slot. Activation heads of the first and second eject levers are 'L'-shaped and 'R'-shaped, respectively, for indicating proper connector orientation. Alternatively, the heads may be '+'-shaped and '−'-shaped, or have differently shaped marks thereon.

6 Claims, 16 Drawing Sheets

CARD EDGE CONNECTOR WITH INSERTION DIRECTION INDICATORS

BACKGROUND OF THE INVENTION

The present invention relates to a card edge connector, and more particularly to a card edge connector for a circuit board or a circuit card.

In personal computers, card edge connectors are provided for receipt of circuit boards or circuit cards. The card edge connector has a slot and a pair of eject levers which are provided at opposite ends of the slot, so that the circuit board or the circuit card is inserted into the slot to attach the circuit board or the circuit card to the card edge connector and the circuit board or the circuit card is fixed by closing the eject levers. The eject levers are opened to remove the circuit board or the circuit card from the card edge connector.

FIG. 1 is a schematic perspective view illustrative of a conventional card edge connector with eject levers. A conventional card edge connector 5 has a slot 51 for insertion of a circuit board or a circuit card and a pair of right and left eject levers 52*r* and 52*l* which are provided at opposite ends of the slot 51. The slot 51 has keys 53 for prevention of an insertion in incorrect direction of the circuit board or the circuit card into the slot 51. The keys 53 are positioned in left half side of the slot 51. The right and left eject levers 52*r* and 52*l* extend upwardly from the opposite ends of the slot 51, wherein lower portions of the right and left eject levers 52*r* and 52*l* are pivotally connected to the opposite ends of the slot 51, so that the right and left eject levers 52*r* and 52*l* are permitted to rotate around the lower portions thereof. Activation heads of the right and left eject levers 52*r* and 52*l* extend in inside directions so that the right and left eject levers 52*r* and 52*l* rotate to close and stand upright to engage the heads of the right and left eject levers 52*r* and 52*l* into recessed portions provided on opposite sides of the circuit board or the circuit card to attach or fix the circuit board or the circuit card to the card edge connector. When the right and left eject levers 52*r* and 52*l* are opened to disengage the heads of the right and left eject levers 52*r* and 52*l* from the recessed portions of the circuit board or the circuit card in order to detach the circuit board or the circuit card from the card edge connector.

In order to satisfy the requirement for a possible reduction of the manufacturing cost, it is preferable that the right and left eject levers 52*r* and 52*l* are symmetrical in shape with each other, for which reason the conventional card edge connector 5 has the symmetrically shaped right and left eject levers 52*r* and 52*l*.

As described above, the keys 53 are provided in order to prevent the insertion in incorrect direction of the circuit board or the circuit card into the slot 51. The positions of the keys 53 are near the left end of the slot 51, whilst the circuit board or the circuit card also has a bottom side which has slits positioned near the left side. The keys 53 of the card edge connector 5 correspond in position to the slits of the circuit board or the circuit card. For those reasons, if the circuit board or the circuit card are about to be inserted into the slot 51, however, in the incorrect direction so that the right side and the left side of the circuit board or the circuit card are reverse to those of the card edge connector 5, then the slits of the circuit board or the circuit card do not correspond in position to the keys 53, whereby the insertion in incorrect direction of the circuit board or the circuit card into the card edge connector 5 is prevented.

The above conventional card edge connector has the following problems. In order to insert the circuit board or the circuit card into the slot 51 of the card edge connector 5, a relatively large force, for example, about 10 kg is necessary. This means that if the insertion direction of the circuit board or the circuit card into the slot 51 of the card edge connector 5 is incorrect, then almost the same force as about 10 kg is applied to the keys 53 and the bottom portion of the circuit board or the circuit card, whereby the keys 53 and the bottom portion of the circuit board or the circuit card might be damaged.

In the above circumstances, it had been required to develop a novel card edge connector free from the above problem.

SUMMARY OF THE INVENTION

Accordingly, it is an object of the present invention to provide a novel card edge connector free from the above problems.

The present invention provides a card edge connector comprising: a slot for receipt of a circuit board or a circuit card ; a first eject lever provided in a first side of said slot ; and a second eject lever provided in a second side of said slot, wherein activation heads of said first and second eject levers are differently shaped from each other.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DESCRIPTION OF THE PREFERRED EMBODIMENTS

Figure 1:
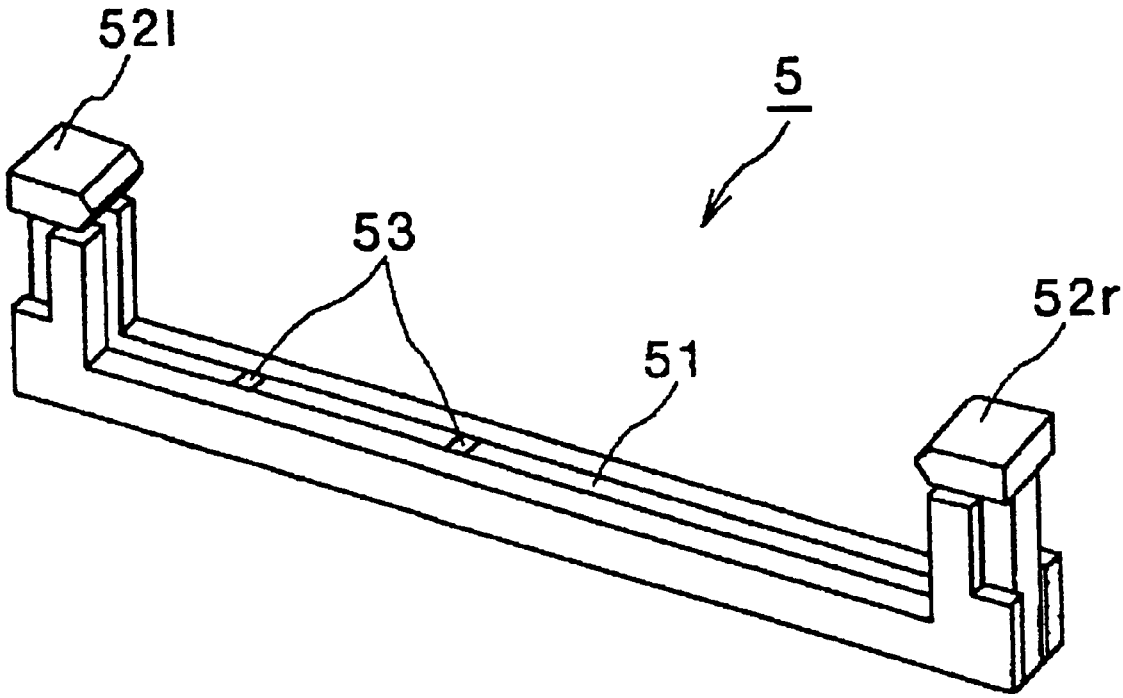
FIG. 1 prior art
FIG. 1 is a schematic perspective view illustrative of a conventional card edge connector with eject levers.

The first aspect of the present invention provides a card edge connector comprising: a slot for receipt of a circuit board or a circuit card; a first eject lever provided in a first side of said slot; and a second eject lever provided in a second side of said slot, wherein activation heads of said first and second eject levers are differently shaped from each other.

It is preferable that said heads of said first and second eject levers have different colors from each other.

It is also preferable that said heads of said first and second eject levers have different colored marks.

It is also preferable that said heads of said first and second eject levers are made of materials having different colors.

It is also preferable that said heads of said first and second eject levers are painted with different colors.

The second present aspect of the invention provides a card edge connector comprising: a slot for receipt of a circuit board or a circuit card ; a first eject lever provided in a first side of said slot; and a second eject lever provided in a second side of said slot, wherein heads of said first and second eject levers have different colors from each other.

It is preferable that said heads of said first and second eject levers have different colored marks.

It is also preferable that said heads of said first and second eject levers are made of materials having different colors.

It is also preferable that said heads of said first and second eject levers are painted with different colors.

It is also preferable that said heads of said first and second eject levers are differently shaped from each other.

The third aspect of the present invention provides a card edge connector comprising a slot for receipt of a circuit board or a circuit card ; a first eject lever provided in a first side of said slot ; and a second eject lever provided in a second side of said slot, wherein heads of said first and second eject levers have marks differently shaped from each other.

It is also preferable that said marks of said first and second eject levers have different colors from each other.

First Embodiment

A first embodiment according to the present invention will be described in detail with reference to FIG. 2 which is a schematic perspective view illustrative of a first novel card edge connector with improved eject levers for prevention of an insertion in incorrect direction of a circuit board or a circuit card into the first novel card edge connector.

The first novel card edge connector 1 has a slot 11 for insertion of a circuit board or a circuit card and a pair of right and left eject levers 12*r* and 12*l* which are provided at opposite ends of the slot 11. The slot 11 has keys 13 for prevention of an insertion in incorrect direction of the circuit board or the circuit card into the slot 11. The keys 13 are positioned in left half side of the slot 11. The right and left eject levers 12*r* and 12*l* extend upwardly from the opposite ends of the slot 11, wherein lower portions of the right and left eject levers 12*r* and 12*l* are pivotally connected to the opposite ends of the slot 11, so that the right and left eject levers 12*r* and 12*l* are permitted to rotate around the lower portions thereof. Activation heads of the right and left eject levers 12*r* and 12*l* extend in inside directions so that the right and left eject levers 12*r* and 12*l* rotate to close and stand upright to engage the heads of the right and left eject levers 12*r* and 12*l* into recessed portions provided on opposite sides of the circuit board or the circuit card to attach or fix the circuit board or the circuit card to the card edge connector. When the right and left eject levers 12*r* and 12*l* are opened to disengage the heads of the right and left eject levers 12*r* and 12*l* from the recessed portions of the circuit board or the circuit card in order to detach the circuit board or the circuit card from the card edge connector.

The heads of the right and left eject levers 12*r* and 12*l* are asymmetrically shaped so that the head of the right eject lever 12*r* is R-shaped whilst the head of the left eject lever 12*l* is L-shaped.

Figure 2:
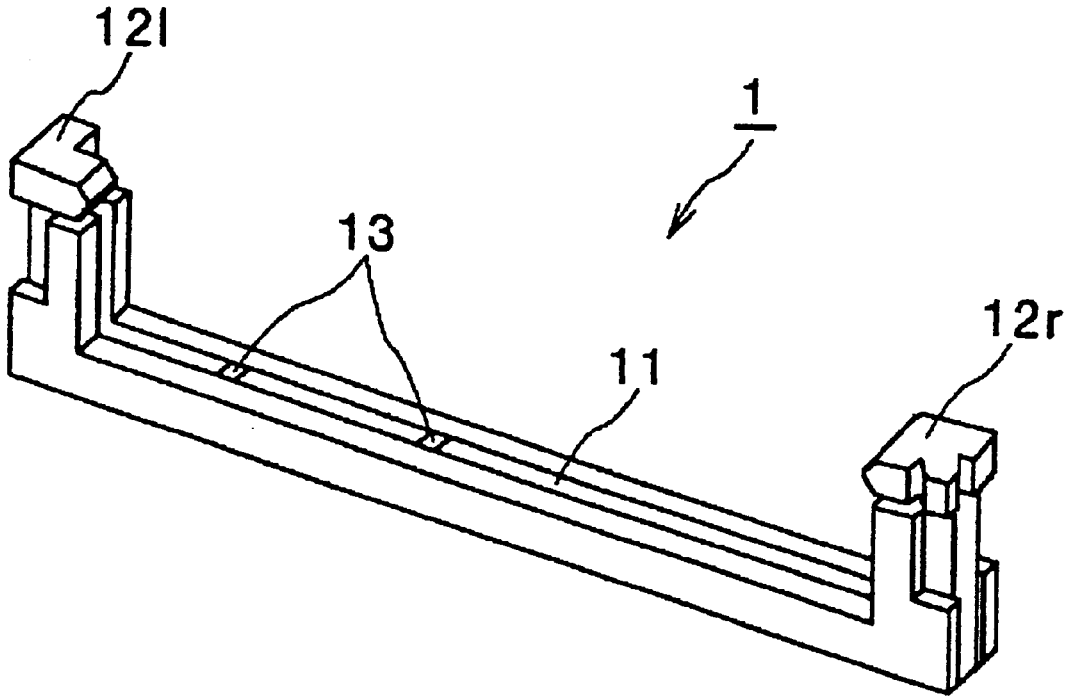
FIG. 2 is a schematic perspective view illustrative of a first novel card edge connector with improved eject levers for prevention of an insertion in incorrect direction of a circuit board or a circuit card into the first novel card edge connector in a first embodiment in accordance with the present invention.
Figure 3A:
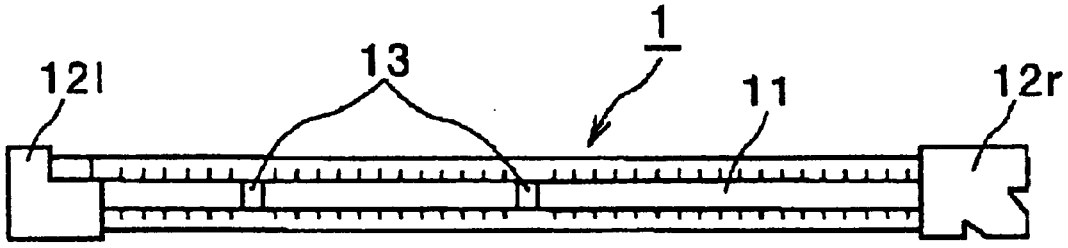
FIG. 3A is a plan view illustrative of the first novel card edge connector of FIG. 2 in the first embodiment in accordance with the present invention.

FIG. 3A is a plan view illustrative of the first novel card edge connector of FIG. 2. As well illustrated, the heads of the right and left eject levers 12*r* and 12*l* are asymmetrically shaped so that the head of the right eject lever 12*r* is R-shaped whilst the head of the left eject lever 12*l* is L-shaped. Further, the keys 13 are positioned closer to the left side of the slot 11.

Figure 3B:
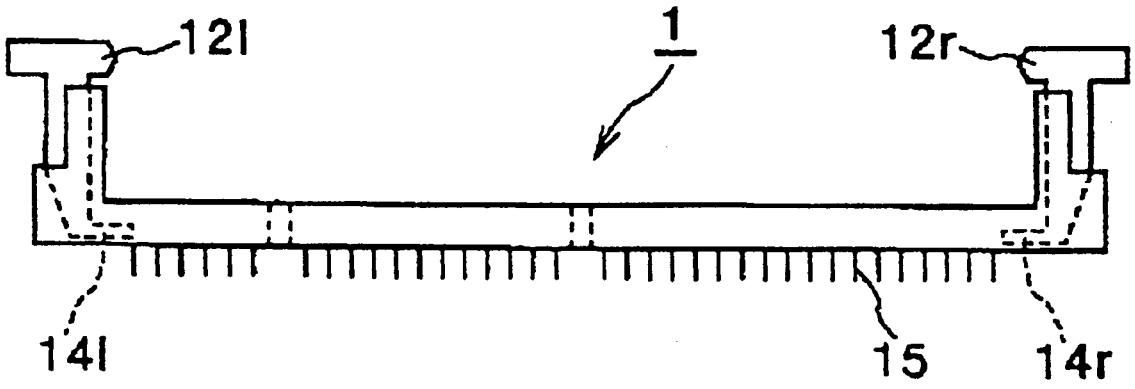
FIG. 3B is a side view illustrative of the first novel card edge connector of FIG. 2 in the first embodiment in accordance with the present invention.

FIG. 3B is a side view illustrative of the first novel card edge connector of FIG. 2. The right and left eject levers 12*r* and 12*l* have right and left hooks 14*r* and 14*l*. When the right and left eject levers 12*r* and 12*l* are opened to disengage the heads of the right and left eject levers 12*r* and 12*l* from the recessed portions of the circuit board or the circuit card, the right and left hooks 14*r* and 14*l* push bottom opposite sides of the circuit board or the circuit card to push up the circuit board or the circuit card thereby to detach the circuit board or the circuit card from the card edge connector. Terminals 15 are aligned on the bottom side of the slot 11 of the card edge connector.

Figure 3C:
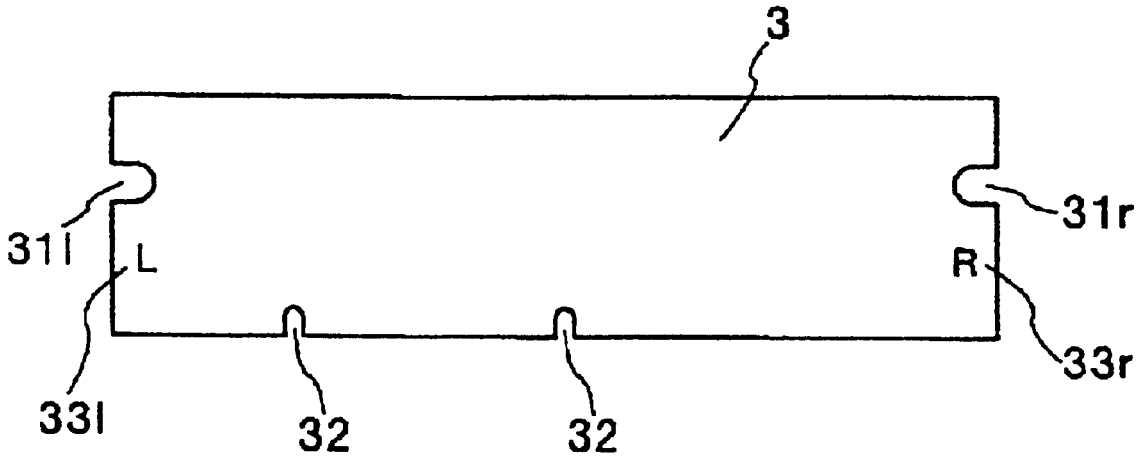
FIG. 3C is a front view illustrative of a circuit board or a circuit card to be inserted into the first novel card edge connector of FIG. 2 in the first embodiment in accordance with the present invention.

FIG. 3C is a front view illustrative of a circuit board 3 or a circuit card to be inserted into the above first novel card edge connector 1. The circuit board 3 is rectangular-shaped and has right and left sides which have right and left recessed portions 31*r* and 31*l*. The right and left recessed portions 31*r* and 31*l* correspond in position to the heads of the right and left eject levers 12*r* and 12*l* when the circuit board 3 or the circuit card is inserted into the card edge connector 1. The circuit board 3 also has slits 32 which correspond in position to the keys 13 of the card edge connector 1 when the circuit board 3 or the circuit card is inserted into the card edge connector 1. The circuit board 3 further has a character display R 33*r* which means the right side and a character display L 33*l* which means the left side.

Figure 4A:
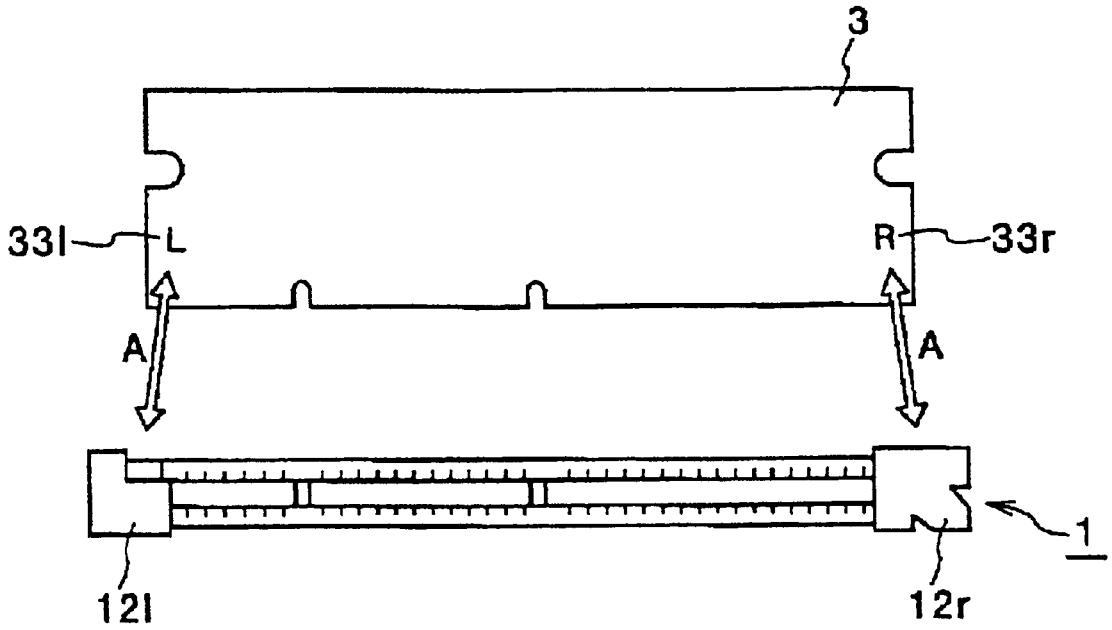
FIGS. 4A through 4C are views illustrative of processes for insertion of the circuit board or the circuit card of FIG. 3C in correct direction into the card edge connector of FIG. 2 in a first embodiment in accordance with the present invention.
Figure 4B:
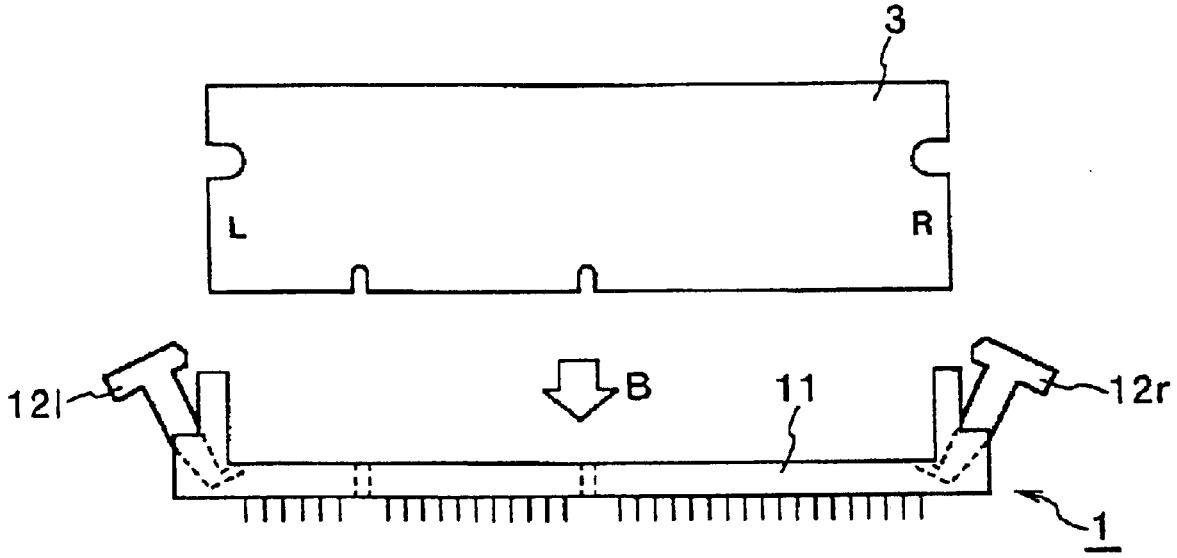
Figure 4C:
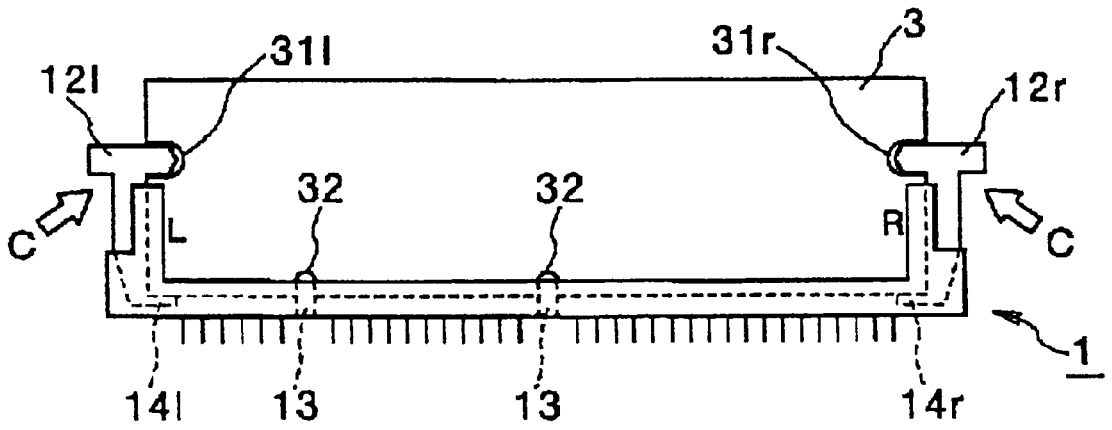

FIGS. 4A through 4C are views illustrative of processes for insertion of the circuit board or the circuit card of FIG. 3C in correct direction into the card edge connector of FIG. 2.

With reference to FIG. 4A, the direction of the circuit board 3 is set so that the right side having the character display R 33*r* of the circuit board 3 corresponds to the right side having the R-shaped head of the right eject lever 12*r*, whilst the left side having the character display L 33*l* of the circuit board 3 corresponds to the left side having the L-shaped head of the left eject lever 12*l*, as indicated by the arrows A.

With reference to FIG. 4B, the right and left eject levers 12*r* and 12*l* are opened to insert the circuit board 3 into the slot 11 of the card edge connector 1, as indicated by the arrow B.

With reference to FIG. 4C, the insertion of the circuit board 3 into the slot 11 results in that the slits 32 of the circuit board 3 are engaged with the keys 13 of the slot 11 of the card edge connector 1, and further results in that the bottom side portions of the circuit board push down the right and left hooks 14*r* and 14*l* of the right and left eject levers 12*r* and 12*l*, whereby the right and left eject levers 12*r* and 12*l* are rotated to stand upright and to be closed, so that the right and left heads of the right and left eject levers 12*r* and 12*l* are engaged into the right and left recessed portions of the circuit board 3, as indicated by the arrows C. As a result, the circuit board 3 is attached and fixed to the card edge holder.

Figure 4D:
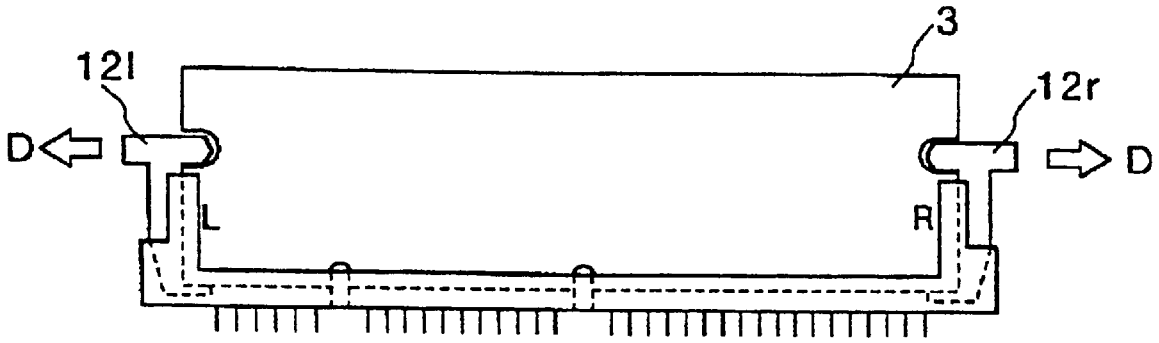
FIGS. 4D through 4E are views illustrative of processes for detaching the circuit board or the circuit card of FIG. 3C from the card edge connector of FIG. 2 in the first embodiment in accordance with the present invention.
Figure 4E:
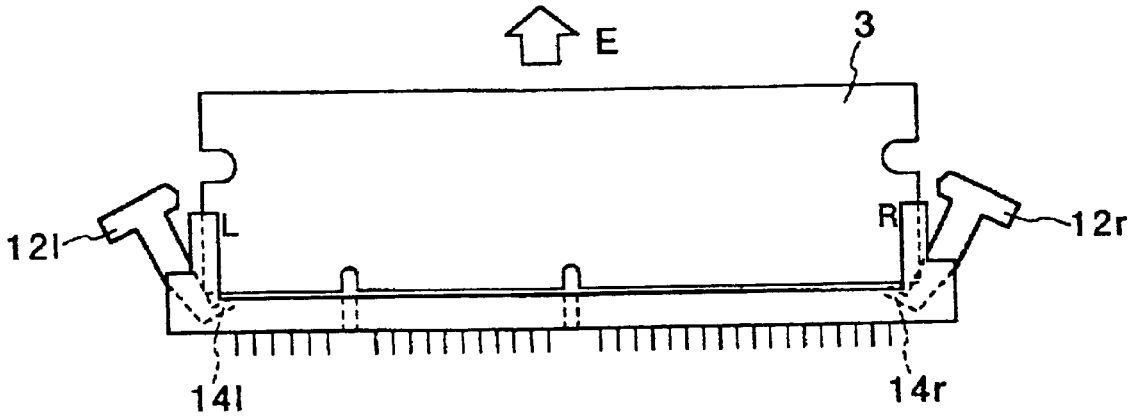

FIGS. 4D through 4E are views illustrative of processes for detaching the circuit board or the circuit card of FIG. 3C from the card edge connector of FIG. 2.

With reference to FIG. 4D, the heads of the right and left eject levers 12*r* and 12*l* are forced to be opened as indicated by the arrows D, whereby the right and left hooks of the right and left eject levers 12*r* and 12*l* push up the bottom of the circuit board 3.

With reference to FIG. 4E, the right and left eject levers 12*r* and 12*l* are opened so that the right and left hooks of the right and left eject levers 12*r* and 12*l* detaches the circuit board 3 from the slot 11 of the card edge connector 1, as indicated by the arrow E.

In accordance with the present invention, the direction of the circuit board 3 is confirmed by confirming the correspondence between the right side having the character display R 33*r* of the circuit board 3 and the right side having the R-shaped head of the right eject lever 12*r* and also the correspondence between the left side having the character display L 33*l* of the circuit board 3 and the left side having the L-shaped head of the left eject lever 12*l* before the circuit board 3 is inserted into the slot 11 of the card edge connector 1. For those reasons, it is possible to prevent the insertion of the circuit board 3 into the slot 11 of the card edge connector 1 in the incorrect direction.

Second Embodiment

Figure 5A:
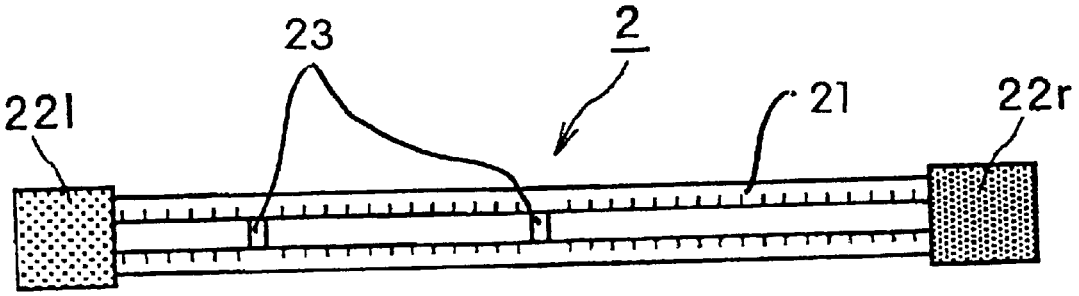
FIG. 5A is a plan view illustrative of a second novel card edge connector with improved eject levers for prevention of an insertion in incorrect direction of a circuit board or a circuit card into the second novel card edge connector in a second embodiment in accordance with the present invention.
Figure 5B:
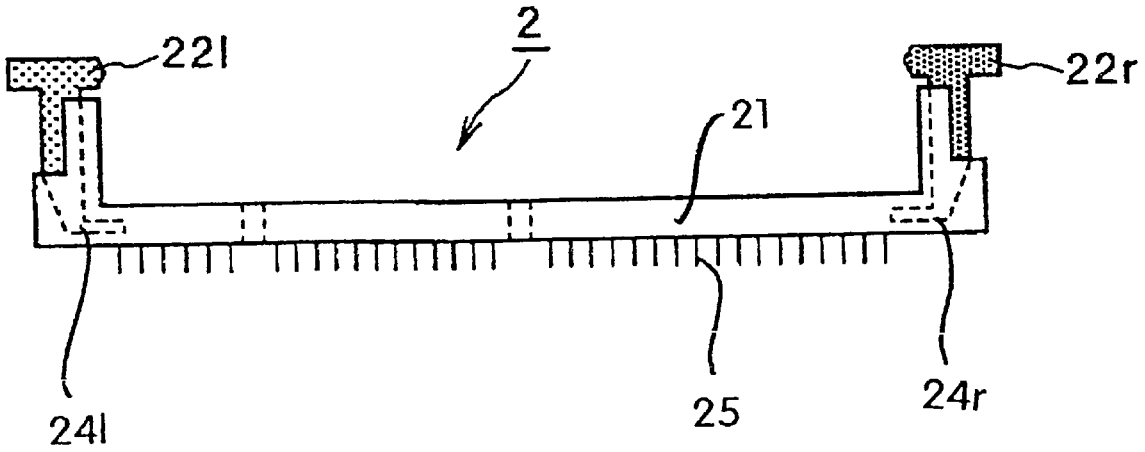
FIG. 5B is a side view illustrative of a second novel card edge connector with improved eject levers for prevention of an insertion in incorrect direction of a circuit board or a circuit card into the second novel card edge connector in the second embodiment in accordance with the present invention.
Figure 5C:
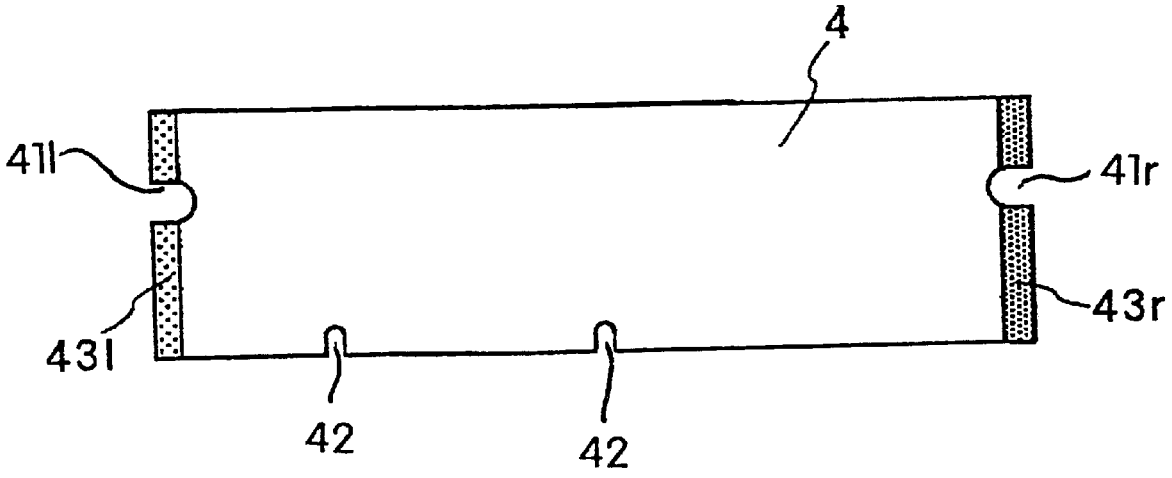
FIG. 5C is a front view illustrative of a circuit board or a circuit card to be inserted into the second novel card edge connector in the second embodiment in accordance with the present invention.

A second embodiment according to the present invention will be described in detail with reference to FIGS. 5A through 5C. FIG. 5A is a plan view illustrative of a second novel card edge connector with improved eject levers for prevention of an insertion in incorrect direction of a circuit board or a circuit card into the second novel card edge connector. FIG. 5B is a side view illustrative of a second novel card edge connector with improved eject levers for prevention of an insertion in incorrect direction of a circuit board or a circuit card into the second novel card edge connector. FIG. 5C is a front view illustrative of a circuit board or a circuit card to be inserted into the second novel card edge connector.

The second novel card edge connector 2 has a slot 21 for insertion of a circuit board or a circuit card and a pair of right and left eject levers 22*r* and 22*l* which are provided at opposite ends of the slot 21. The slot 21 has keys 23 for prevention of an insertion in incorrect direction of the circuit board or the circuit card into the slot 21. The keys 23 are positioned in left half side of the slot 21. The right and left eject levers 22*r* and 22*l* extend upwardly from the opposite ends of the slot 21, wherein lower portions of the right and left eject levers 22*r* and 22*l* are pivotally connected to the opposite ends of the slot 21, so that the right and left eject levers 22*r* and 22*l* are permitted to rotate around the lower portions thereof. Heads of the right and left eject levers 22*r* and 22*l* extend in inside directions so that the right and left eject levers 22*r* and 22*l* rotate to close and stand upright to engage the heads of the right and left eject levers 22*r* and 22*l* into recessed portions provided on opposite sides of the circuit board or the circuit card to attach or fix the circuit board or the circuit card to the card edge connector. When the right and left eject levers 22*r* and 22*l* are opened to disengage the heads of the right and left eject levers 22*r* and 22*l* from the recessed portions of the circuit board or the circuit card in order to detach the circuit board or the circuit card from the card edge connector.

The heads of the right and left eject levers 22*r* and 22*l* are symmetrically shaped but the right and left eject levers 22*r* and 22*l* have different colors, for example, a first color which means the right side and a second color which means a second color. There are three ways to provide the right and left eject levers 22*r* and 22*l* with the right and left side colors. The first way is to use different color materials for the right and left eject levers 22*r* and 22*l*. The second way is to paint the right and left eject levers 22*r* and 22*l* with different coloring materials. The third way is to put different color seals or different color marks on the right and left eject levers 22*r* and 22*l*.

The right and left eject levers 22*r* and 22*l* have different colors. Further, the keys 23 are positioned closer to the left side of the slot 21.

The right and left eject levers 22*r* and 22*l* have right and left hooks 24*r* and 24*l*. When the right and left eject levers 22*r* and 22*l* are opened to disengage the heads of the right and left eject levers 22*r* and 22*l* from the recessed portions of the circuit board or the circuit card, the night and left hooks 24*r* and 24*l* push bottom opposite sides of the circuit board or the circuit card to push up the circuit board or the circuit card thereby to detach the circuit board or the circuit card from the card edge connector Terminals 25 are aligned on the bottom side of the slot 11 of the card edge connector.

The circuit board 4 is rectangular-shaped and has right and left sides which have right and left recessed portions 41*r* and 41*l*. The right and left recessed portions 41*r* and 41*l* correspond in position to the heads of the right and left eject levers 22*r* and 22*l* when the circuit board 4 or the circuit card is inserted into the card edge connector 2. The circuit board 4 also has slits 42 which correspond in position to the keys 23 of the card edge connector 2 when the circuit board 4 or the circuit card is inserted into the card edge connector 2. The circuit board 4 further has a right side colored region 43*r* which means the right side and a left side colored region 43*l* which means the left side, wherein the right side colored region 43*r* of the circuit board 4 has the same color as the right eject lever 22*r* , whilst the left side colored region 43*l* of the circuit board 4 has the same color as the left eject lever 22*l*.

The direction of the circuit board 3 is set so that the right side colored region 43*r* of the circuit board 3 corresponds to the right eject lever 22*r* , whilst the left side colored region 43*l* of the circuit board 4 corresponds to the left eject lever 22*l*.

The right and left eject levers 22*r* and 22*l* are opened to insert the circuit board 4 into the slot 21 of the card edge connector 2.

The insertion of the circuit board 4 into the slot 21 results in that the slits 42 of the circuit board 4 are engaged with the keys 23 of the slot 21 of the card edge connector 2, and further results in that the bottom side portions of the circuit board push down the right and left hooks 24*r* and 24*l* of the right and left eject levers 22*r* and 22*l*, whereby the right and left eject levers 22*r* and 22*l* are rotate to stand upright and to be closed, so that the right and left heads of the right and left eject levers 22*r* and 22*l* are engaged into the right and left recessed portions of the circuit board 4. As a result, the circuit board 4 is attached and fixed to the card edge holder.

The heads of the right and left eject levers 22*r* and 22*l* are forced to be opened whereby the right and left hooks of the right and left eject levers 22*r* and 22*l* push up the bottom of the circuit board 4.

The right and left eject levers 22*r* and 22*l* are opened so that the right and left hooks of the right and left eject levers 22*r* and 22*l* detaches the circuit board 4 from the slot 21 of the card edge connector 2.

In accordance with the present invention, the direction of the circuit board 4 is confirmed by confirming the correspondence in color between the right side colored region 43*r* of the circuit board 4 and the right eject lever 22*r* and also the correspondence in color between the left side colored region 43*l* of the circuit board 4 and the left eject lever 22*l* before the circuit board 4 is inserted into the slot 21 of the card edge connector 2. For those reasons, it is possible to prevent the insertion of the circuit board 4 into the slot 21 of the card edge connector 2 in the incorrect direction.

Third Embodiment

Figure 6A:
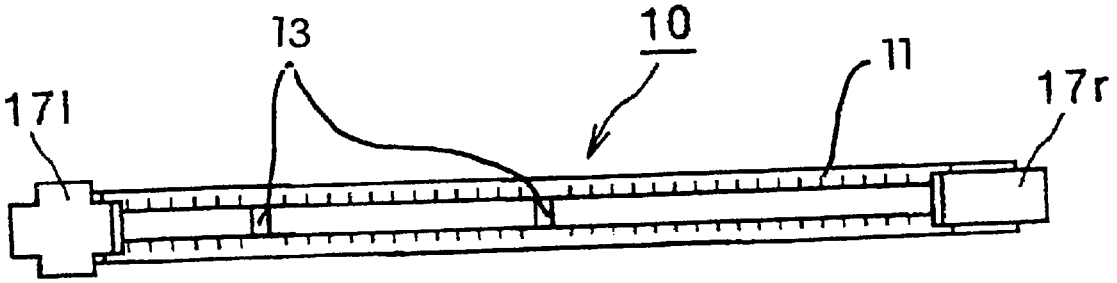
FIG. 6A is a plan view illustrative of a third novel card edge connector with improved eject levers for prevention of an insertion in incorrect direction of a circuit board or a circuit card into the second novel card edge connector in a third embodiment in accordance with the present invention.
Figure 6B:
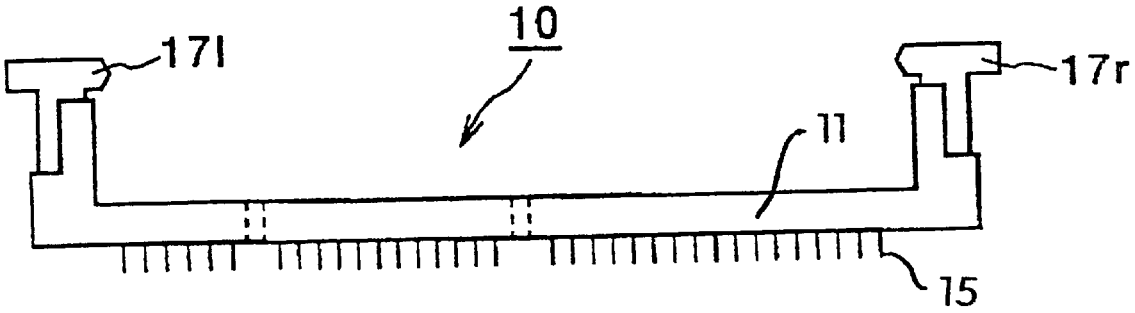
FIG. 6B is a side view illustrative of a third novel card edge connector with improved eject levers for prevention of an insertion in incorrect direction of a circuit board or a circuit card into the second novel card edge connector in the third embodiment in accordance with the present invention.
Figure 6C:
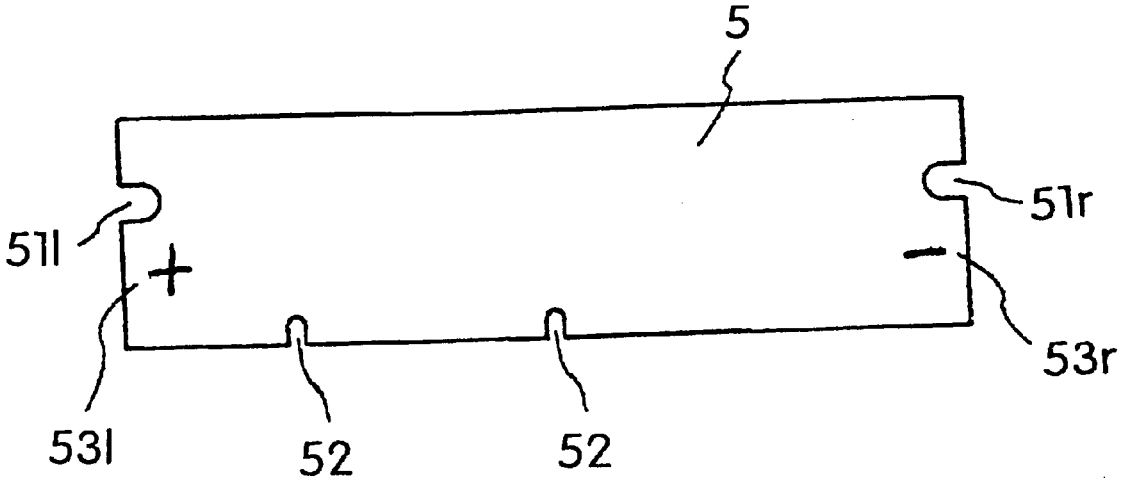
FIG. 6C is a front view illustrative of a circuit board or a circuit card to be inserted into the third novel card edge connector in the third embodiment in accordance with the present invention.

A third embodiment according to the present invention will be described in detail with reference to FIGS. 6A through 6C. FIG. 6A is a plan view illustrative of a third novel card edge connector with improved eject levers for prevention of an insertion in incorrect direction of a circuit board or a circuit card into the second novel card edge connector. FIG. 6B is a side view illustrative of a third novel card edge connector with improved eject levers for prevention of an insertion in incorrect direction of a circuit board or a circuit card into the second novel card edge connector. FIG. 6C is a front view illustrative of a circuit board or a circuit card to be inserted into the third novel card edge connector.

The third novel card edge connector 10 has a slot 11 for insertion of a circuit board or a circuit card and a pair of right and left eject levers 17*r* and 17*l* which are provided at opposite ends of the slot 11. The slot 11 has keys 13 for prevention of an insertion in incorrect direction of the circuit board or the circuit card into the slot 11. The keys 13 are positioned in left half side of the slot 11. The right and left eject levers 17*r* and 17*l* extend upwardly from the opposite ends of the slot 11, wherein lower portions of the right and left eject levers 17*r* and 17*l* are pivotally connected to the opposite ends of the slot 11, so that the right and left eject levers 17*r* and 17*l* are permitted to rotate around the lower portions thereof. Heads of the right and left eject levers 17*r* and 17*l* extend in inside directions so that the right and left eject levers 17*r* and 17*l* rotate to close and stand upright to engage the heads of the right and left eject levers 17*r* and 17*l* into recessed portions provided on opposite sides of the circuit board or the circuit card to attach or fix the circuit board or the circuit card to the card edge connector. When the right and left eject levers 17*r* and 17*l* are opened to disengage the heads of the right and left eject levers 17*r* and 17*l* from the recessed portions of the circuit board or the circuit card in order to detach the circuit board or the circuit card from the card edge connector.

The heads of the night and left eject levers 17*r* and 17*l* are asymmetrically shaped so that the head of the right eject lever 17*r* is "–"-shaped whilst the head of the left eject lever 17*l* is "+"-shaped.

The heads of the right and left eject levers 17*r* and 17*l* are asymmetrically shaped so that the head of the right eject lever 17*r* is "–"-shaped whilst the head of the left eject lever 17*l* is "+"-shaped. Further, the keys 13 are positioned closer to the left side of the slot 11.

The right and left eject levers 17*r* and 17*l* have right and left hooks. When the right and left eject levers 17*r* and 17*l* are opened to disengage the heads of the right and left eject levers 17*r* and 17*l* from the recessed portions of the circuit board or the circuit card, the right and left hooks push bottom opposite sides of the circuit board or the circuit card to push up the circuit board or the circuit card thereby to detach the circuit board or the circuit card from the card edge connector. Terminals 15 are aligned on the bottom side of the slot 11 of the card edge connector.

The circuit board 3 is rectangular-shaped and has right and left sides which have right and left recessed portions 51*r* and 51*l*. The right and left recessed portions 51*r* and 51*l* correspond in position to the heads of the right and left eject levers 17*r* and 17*l* when the circuit board 5 or the circuit card is inserted into the card edge connector 10. The circuit board 5 also has slits 52 which correspond in position to the keys 13 of the card edge connector 10 when the circuit board 5 or the circuit card is inserted into the card edge connector 10. The circuit board 5 further has a character display "–" 53*r* which means the right side and a character display "+" 53*l* which means the left side.

The direction of the circuit board 5 is set so that the right side having the character display "–" 53*r* of the circuit board 5 corresponds to the right side having the "–"-shaped head of the right eject lever 17*r*, whilst the left side having the character display "–" 53*l* of the circuit board 5 corresponds to the left side having the "+"-shaped head of the left eject lever 17*l*.

The night and left eject levers 17*r* and 17*l* are opened to insert the circuit board 5 into the slot 11 of the card edge connector 10.

The insertion of the circuit board 5 into the slot 11 results in that the slits 52 of the circuit board 5 are engaged with the keys 13 of the slot 11 of the card edge connector 10, and further results in that the bottom side portions of the circuit board push down the right and left hooks of the right and left eject levers 17*r* and 17*l*, whereby the right and left eject levers 17*r* and 17*l* are rotate to stand upright and to be closed, so that the right and left heads of the right and left eject levers 17*r* and 17*l* are engaged into the right and left recessed portions of the circuit board 5. As a result, the circuit board 5 is attached and fixed to the card edge holder.

The heads of the right and left eject levers 17*r* and 17*l* are forced to be opened whereby the right and left hooks of the right and left eject levers 17*r* and 17*l* push up the bottom of the circuit board 5.

The right and left eject levers 17*r* and 17*l* are opened so that the right and left hooks of the right and left eject levers 17*r* and 17*l* detaches the circuit board 5 from the slot 11 of the card edge connector 10.

In accordance with the present invention, the direction of the circuit board 5 is confirmed by confirming the correspondence between the right side having the character display "−" 53*r* of the circuit board 5 and the right side having the "−"-shaped head of the right eject lever 17*r* and also the correspondence between the left side having the character display "+" 53*l* of the circuit board 5 and the left side having the "+"-shaped head of the left eject lever 17*l* before the circuit board 5 is inserted into the slot 11 of the card edge connector 10. For those reasons, it is possible to prevent the insertion of the circuit board 5 into the slot 11 of the card edge connector 10 in the incorrect direction.

As a modification to the above first to third embodiments, it is possible that the right and left eject levers are designed to hold the top side of the circuit board or the circuit card.

As a further modification, it is also possible to put labels or seals which are differently shaped onto the heads of the right and left eject levers. For example, the differently shaped labels or seals may comprise "R" and "L" or "−" and "+".

As a further more modification, it is also possible to utilize the asymmetrical shapes of the heads of the right and left eject levers having different colors to each other and also utilize the circuit board or the circuit card having the right and left side colored regions which have different colors from each other but those different colors of the right and left side colored regions correspond to the colors of the right and left eject levers.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A card edge connector comprising:

a slot for receipt of a circuit board or a circuit card;

a first eject lever provided in a left side of said slot; and a second eject lever provided in a right side of said slot, wherein an actuation head of said first eject lever is 'L'-shaped in plan view and an actuation head of said second elect lever is 'R'-shaped in plan view.

2. The card edge connector as claimed in claim 1, wherein said heads of said first and second eject levers comprise different colors from each other.

3. The card edge connector of claim 1 in combination with one of the circuit board and the circuit card, wherein a left side of said one circuit board or card comprises an 'L'-shaped mark and a right side of said one circuit board or card comprises an 'R'-shaped mark.

4. A card edge connector comprising:

a slot for receipt of a circuit board or a circuit card;

a first eject lever provided in a first side of said slot; and a second eject lever provided in a second side of said slot, wherein an actuation head of said first elect lever a plus sign-shaped in plan view, and an actuation head of said second eject lever is a minus sign-shaped in plan view.

5. The card edge connector as claimed in claim 4, wherein said heads of said first and second eject levers comprise different colors from each other.

6. The card edge connector of claim 4 in combination with one of the circuit board and the circuit card, wherein a first side of said one circuit board or card comprises a plus sign-shaped mark and a second side of said one circuit board or card comprises a minus sign-shaped mark.

* * * * *